United States Patent [19]

Gambs et al.

[11] 4,059,060

[45] Nov. 22, 1977

[54] METHOD AND APPARATUS FOR COAL TREATMENT

[75] Inventors: Gerard C. Gambs, New York, N.Y.; Horace P. Morgan, Plainfield, N.J.

[73] Assignee: Ford, Bacon & Davis, Incorporated, New York, N.Y.

[21] Appl. No.: 671,111

[22] Filed: Mar. 29, 1976

[51] Int. Cl.[2] ..... F23K 1/04

[52] U.S. Cl. ..... 110/1 J; 44/1 R; 44/1 G; 44/2; 110/106

[58] Field of Search ..... 44/1 R, 1 A, 1 B, 1 C, 44/1 D, 1 G, 2; 110/1 J, 1 K, 7 R, 8 R, 15, 106

[56] References Cited

U.S. PATENT DOCUMENTS

| | | | |
|---|---|---|---|
| 2,716,002 | 8/1955 | Craig | 110/106 |
| 3,002,472 | 10/1961 | Miller | 110/106 |
| 3,043,525 | 7/1962 | Gilbert | 110/106 |
| 3,640,016 | 2/1972 | Lee et al. | 44/1 |
| 3,909,212 | 9/1975 | Schroeder | 44/1 |
| 3,917,465 | 11/1975 | Meyers | 44/2 |

*Primary Examiner*—Kenneth W. Sprague
*Attorney, Agent, or Firm*—Cooper, Dunham, Clark, Griffin & Moran

[57] ABSTRACT

Method and apparatus for upgrading subbituminous coal and/or lignite fuel product that does not comply with an applicable $SO_x$:Btu standard during the combustion thereof. The fuel product is treated at the combustion site to lower the total moisture content thereof from between about 15 and 45 percent to between about 4 and 7 percent. Heavier weight ash particles are removed from the fuel product to lower the sulfur content thereof. The treated fuel product is burned while it is in the 4 to 7 percent total moisture range, thereby meeting the applicable $SO_x$:Btu standard during the combustion process.

12 Claims, 3 Drawing Figures

METHOD AND APPARATUS FOR COAL TREATMENT

BACKGROUND AND BRIEF DESCRIPTION OF THE INVENTION

This invention relates to the burning of fuel products, and more particularly is directed to rendering a combustion process in compliance with an applicable $SO_X$:Btu standard. The invention is particularly concerned with the upgrading of subbituminous coal and/or lignite fuel products so that they comply with such a standard.

At the present time, the Federal Government and many states have imposed $SO_X$:Btu standards for the burning of fuels. As noted in *Report on Sulfur Oxide Control Technology,* published in 1975 by the U.S. Department of Commerce, Commerce Technical Advisory Board, The Environmental Protection Agency (EPA) has adopted a national standard which limits $SO_2$ emissions by each "new" coal-fired (i.e., installation commenced after August 1971) stationary source to 1.2 lbs. of $SO_2$ per million Btu of heat input. The panel that published this report considered the following five potential near-term options for continuously meeting emissions standards of coal-fired electricity generating plants:

1. Use of low sulfur coal (Eastern & Western)
2. Use of coal beneficiation (cleaning)
3. Use of sludge-producing flue gas desulfurization (F.G.D.)
4. Use of coal beneficiation combined with flue gas desulfurization (F.G.D.)
5. Use of regenerative F.G.D.

None of these alternatives gave serious consideration to the use of subbituminous coal and/or lignite fuel relatively high in total moisture content. In fact, as pointed out in the publication *Burning the Sub-bituminous Coals of Montana and Wyoming in Large Utility Boilers,* by R. J. Gray and G. F. Moore, published by The American Society of Mechnical Engineers (1975), the lower heat content of lignites and subbituminous coals "creates a problem, primarily because it takes more coal for a given heat input." As also noted, because of their low calorific values, some of these coals will not meet the Federal air pollution requirement of 1.2 lbs. of $SO_2$ per million Btu heat input, even though they are low in sulfur content.

Electric utility companies have accordingly found that they are unable to use some western subbituminous coal and lignite fuel products as they are presently produced.

On the other hand, some electric utility companies have decided in order to use some western subbituminous coal and lignite fuel products that they will install stack gas scrubbing systems in order to comply with EPA regulations related to sulfur dioxide.

The present invention is directed to the use of such fuel products, and specifically to upgrading them from a condition in which they are non-complying with the applicable $SO_X$:Btu standard to a condition in which the product is in compliance during the combustion process. This invention provides such upgrading by treatment at the combustion site. The invention is particularly concerned with such upgrading of a fuel product without an associated high cost.

The present invention proceeds on the basis that an applicable $SO_X$:Btu standard may be met raising sufficiently the heating value of the fuel product without necessarily resorting to sulfur removal processes so that the $SO_X$:Btu standard will be met during the combustion process. Thus this invention primarily approaches the problem from the standpoint of raising the heating value rather than lowering the sulfur content.

Recognizing that total moisture is the major cause of relatively low heating values of western subbituminous coals and lignite fuel products, the present invention contemplates drying a fuel product at the combustion site to lower significantly the total moisture content of the fuel product and to concomitantly raise it sufficiently so that the $SO_X$:Btu standard will be met during the combustion process. Additionally, the product may be "cleaned" i.e., made to undergo particle weight separation so that heavier weight ash particles containing sulfur are removed. In this fashion some sulfur reduction is achieved as well as increasing the heating value of the fuel product, all to contribute toward the lowering of the $SO_X$:Btu ratio so that it is in compliance with the applicable emission standard during the combustion process.

Fuel drying has taken place at the combustion site in the past. Many utilities recognize the fact that increased pulverizer efficiencies may be obtained if the fuel product is dried prior to introduction to the pulverizer. To this extent, fuel drying is presently being practiced by many utilities. However, there is no appreciation of the fact that a non-compliant fuel product (non-complying with applicable $SO_X$:Btu standards) may be upgraded so that it is a compliant fuel product by the use of fuel drying. Kreisinger et al U.S. Pat. No. 1,608,699 is typical of a prior art system utilizing drying ahead of a pulverizer to increase pulverizer efficiency. A system such as shown in that patent would be suitable for the processing of subbituminous coal and lignite fuel products that need only be dried in order to meet the applicable $SO_X$:Btu standard. Kreisinger, however, does not provide for cleaning.

In the practice of the present invention, waste heat from the combustion process itself may be utilized in a recycling thereof for the purpose of carrying out the drying operation. Additionally, since the drying of the fuel product increases the efficiency of the pulverizing unit, advantage may be taken of this increased efficiency by utilizing pulverization at different stages during the treatment process, for example, providing an initial pulverizing operation, followed by a separation of heavier weight sulfur-containing ash particles, followed by a final pulverizing operation.

The invention will be more completely understood by reference to the following detailed description, when taken in conjunction with the appended drawing.

DETAILED DESCRIPTION

Figures 1, 2, 3:
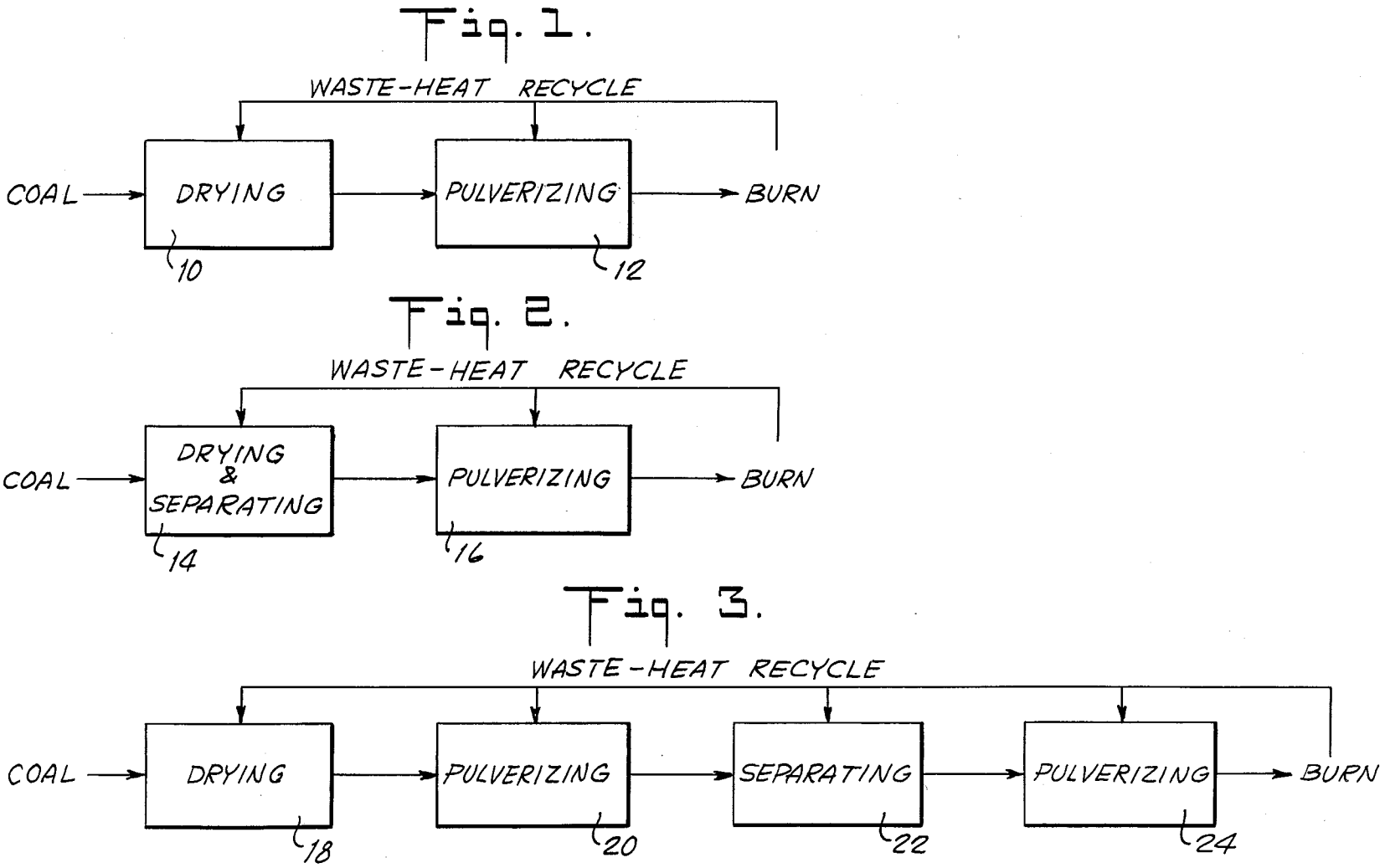
FIGS. 1 to 3 illustrate, in block diagram form, the practice of the invention.

Before a detailed description of the invention is given, it will be best to consider some various relationships regarding coal and the burning thereof. As noted above, emission standards for $SO_X$ emissions are expressed in terms of pounds of $SO_2$ per million Btu of heat input. The present national standard adopted by the EPA is that $SO_2$ emissions may not exceed 1.2 lbs. of $SO_2$ per million Btu of heat input. This relationship is expressed as follows:

$$\frac{\text{lbs. } SO_2}{\text{million Btu}} \leqq \text{emission standard} \quad (1a)$$

It is well known that the pounds of sulfur dioxide emitted from a fuel product may be approximated from the percentage of sulfur in the dry product as follows:

$$\text{lbs. } SO_2 = S\% \times 10^{-2} \times 2 \quad 1b$$

In equation (1*b*) the sulfur percentage, S%, is in terms of the dry product, as is conventional.

Relation (1*a*) may accordingly be rewritten as follows by substitution from equation (1b):

$$\frac{S\% \times 10^{-2} \times 2}{\text{million Btu}} \leqq \text{emission standard} \quad (1c)$$

Coal is normally defined in terms of its heating value, namely, the Btus of heat input per pound of coal. Thus, the factor "million Btu" in relation (1*c*) may be expressed in terms of the actual heating value, and relation (1*c*) may be rewritten as follows:

$$\frac{S\% \times 10^{-2} \times 2}{\text{heating value}/10^6} \leqq \text{emission standard} \quad (1d)$$

The terms in relation (1*d*) may be rearranged to provide the following relation:

$$S\% \leqq \text{heating value x emission standard} \times 5 \times 10^{-5} \quad (1e)$$

In relation (1*e*), the percent sulfur is expressed as a dry product percentage. Relation (1*e*) thus indicates the upper limit of that sulfur percentage in a fuel product in order to comply with applicable emission standards.

Another relationship that is important is as follows:

$$\frac{\text{Heating value}_{(1)}}{\text{Heating value}_{(2)}} = \frac{1 - \text{moisture \& ash content}_{(1)}}{1 - \text{moisture \& ash content}_{(2)}} \quad (2)$$

Equation (2) defines the well known relationship between heating values of the same basic fuel product with different moisture and ash contents. In equation (2), the moisture and ash content is expressed as a fraction or as a decimal. It is apparent from equation (2) that heating value varies directly with the moisture and ash content, and for each percentage decrease of moisture and ash content the heating value will increase by a corresponding percent.

Equation (2) may be rewritten as follows:

$$\text{Heating value}_{(2)} = \text{Heating value}_{(1)} \frac{[100\% - \text{moisture \& ash}\%_{(2)}]}{[100\% - \text{moisture \& ash}\%_{(1)}]} \quad (3)$$

Equation (3) expresses the heating value$_{(2)}$ of a particular fuel product having a moisture and ash percentage$_{(2)}$ in terms of the heating value$_{(1)}$ of the same fuel product and of a corresponding moisture and ash percentage$_{(1)}$.

Relation (1*e*) may thus be rewritten in terms of equation (3) as follows:

$$\frac{S\%}{100\% - \text{moisture \& ash}\%_{(2)}} \leqq \frac{\text{Heating value}_{(1)} \times \text{emission standard} \times 5 \times 10^{-5}}{100\% - \text{moisture \& ash}\%_{(1)}} \quad (4)$$

In relation (4) the left-hand portion thereof is a ratio that is termed herein the "Sulfur Factor". Thus the Sulfur Factor is the ratio of percent sulfur in a fuel product to the percent of non-moisture and ash components of that fuel product (100% less the moisture and ash percentage). AS noted above, the sulfur percentage is expressed on a "dry product" basis, and hence does not vary. The moisture and ash percentage, on the other hand, is on an "as received" or overall product basis, and hence may vary as the fuel product is treated. Relation (4) indicates that the Sulfur Factor must be less than a value dependent upon the initial heating value, the initial non-moisture and ash percentage in that fuel product and the emission standard. The initial heating value, i.e., the heating value$_{(1)}$ appearing in the right-hand portion of relation (4) is typically the "as received" heating value of the fuel product, e.g., as received by a utility and including the usual moisture and ash content accompanying that product.

It will be noted, that for any "as received" fuel product, the right-hand portion of relation (4) is constant. A portion of that constant is known as the moisture and ash free heating value of the fuel product. Specifically, the heating value$_{(1)}$ divided by the non-moisture and ash content [100% — moisture and ash%$_{(1)}$] represents the heating value of the fuel product on a moisture and ash free basis. That moisture and ash free heating value is thus multiplied by a constant, including the applicable emission standard, to produce a constant factor representing the right-hand portion of relation (4).

In other words, relation (4) may be expressed as $$\text{Sulfur Factor} = \frac{S\%}{\text{non-moisture \& ash}\%_{(2)}} \leqq k \times \text{heating value}_{MAF} \quad (5)$$

in which the heating value$_{MAF}$ is the moisture and ash free heating value of the fuel product and $K$ is a constant dependent upon the applicable $SO_X$:Btu emission standard.

Relation (5) is useful in examining any "as received" fuel product and determining the upper limit of the Sulfur Factor. In particular, consider the following Table I which characterizes two representative fuel products, namely, Wyoming Powder River Coal Basin (Anderson Seam) subbituminous coal and North Dakota lignite. The data for the table were taken from the Gray and Moore publication cited above, page 2, and *Review of Wyoming Coalfields,* 1975, by Gary B. Glass and published by Geological Survey of Wyoming, page 9.

TABLE I

| | Wyoming Powder River Coal Basin (Anderson Seam) Subbituminous Coal | North Dakota Lignite |
|---|---|---|
| Moisture (Total) | 29.5% | 37.6% |
| Volatile Matter, fixed carbon & ash | 70.5% | 62.4% |

TABLE I-continued

| | | Wyoming Powder River Coal Basin (Anderson Seam) Subbituminous Coal | North Dakota Lignite |
|---|---|---|---|
| Sulfur (dry basis) | | 0.52% | 0.8% |
| Ash | | 6.5% | 7.0% (11.2% dry) |
| Moisture & Ash (as received) | | 36% | 44.6% |
| Non-Moisture & Ash (as received) | | 64% | 55.4% |
| Heating VAlue (Btu/lg.) | - as received | 7,979 | 6,664 |
| " | - dry | 11,300 | 10,680 |
| 41 | - moisture & ash free | 12,450 | 12,050 |
| Sulfur Factor$_{max}$* | | 0.00747 | 0.00723 |
| lbs. $SO_2$/million Btu (as received) | | 1.30 | 2.40 |

*for $SO_2$:Btu less than 1.2 lbs. $SO_2$/million But as an emission standard

Each of the fuels is characterized by a total moisture percentage, with the remaining percentage of product being constituted by volatile matter, fixed carbon, and ash. The sulfur content is given as a percentage on a dry basis, while the ash content is given as a percentage of the total product. The moisture and ash in the "as received" product is given as a percentage figure, as well as the non-moisture and ash portion. The "as received" heating value is specified, as well as the computed heating values of the dry product (considered as if total moisture were completely removed) and the moisture and ash free product. Based upon the moisture and ash free heating value [see relation (5)], the maximum permissible Sulfur Factor is designated. The figures developed are for an $SO_2$:Btu emission standard of no more than 1.2 lbs. of $SO_2$ per million Btu of heat input. In this case, the value of $k$ from relation (5) is equal to $6 \times 10^{-7}$.

Table I also specifies, for the "as received" fuel product, the computed ratio of pounds of $SO_2$ per million Btu. It will be noted that the ratio is 1.30 for the Wyoming subbituminous coal and 2.40 for the North Dakota lignite, both are non-compliant with the presently existing EPA emission standard of 1.20. Wyoming subbituminous coal may be treated prior to the combustion process, at the combustion site, by undergoing a drying process in which the total moisture is reduced to about 5%. Reductions below about 5% total moisture are not desirable because of the dust condition that is created, producing a highly explosive product. Table 2 tabulates the results of the treatment.

TABLE 2

| | Wyoming Powder River Coal Basin (Anderson Seam) Subbituminous Coal | North Dakota Lignite | |
|---|---|---|---|
| Moisture (total) | 5% | 5% | 5% |
| Volatile matter, fixed carbon & ash | 95% | 95% | 95% |
| Sulfur (dry basis) | 0.52% | 0.8% | 0.6% |
| Ash | 8.8% | 10.7% | 5% |
| Non-Moisture & Ash% | 86.2% | 84.3% | 90% |
| Sulfur Factor | 0.006 | 0.0095 | 0.0067 |
| Heating value (Btu/lb.) | 10,750 | 10,150 | 10,850 |
| lbs. $SO_2$/million But (as treated) | 0.97 | 1.57 | 1.10 |

In Table 2, the total moisture is indicated as being reduced to 5%. The remainder, namely, volatile matter, fixed carbon, and ash, constitutes 95%. The sulfur percentage of the product does not change, and remains at 0.52% for the Wyoming subbituminous coal. The ash percentage increases as a percentage of the total product from 6.5% (Table I) to 8.8% (by virtue of the reduction in total moisture). The non-moisture and ash percent is at 86.2%, and the Sulfur Factor is computed from relation (5) to be 0.006. Since the maximum value of that sulfur factor from Table I is 0.00747, it is apparent that this moisture removal treatment of the Wyoming subbituminous coal is sufficient to render that coal product in compliance with the applicable EPA emission standard. Note also from Table 2 that the computed heating value for the coal product following treatment is elevated to 10,750 Btu per pound, significantly higher than the heating value of 7,979 Btu per pound in the "as received" condition. The pounds of $SO_2$ emitted for each million Btu heat generated has been computed to be 0.97 for this Wyoming subbituminous coal following treatment to reduce the total moisture to 5%. This is well within the upper limit of 1.2 constituting the EPA emission standard.

This Wyoming subbituminous coal is an example of a fuel product which may be rendered in compliance with the applicable EPA emission standard simply by reducing the total moisture content of the fuel product. Many other fuel products cannot be upgraded simply by moisture reduction. The North Dakota lignite is an example of such a fuel product. Referring to Table 2, the first column of figures for North Dakota lignite, assume that the total moisture content is reduced to 5%. The sulfur percentage, on a dry basis, remains at 0.8%. The ash percentage increases to 10.7% from the 7.0 percentage in the "as received" condition as noted in Table I. The non-moisture and ash percentage of this product is 84.3%. The Sulfur Factor computes to be 0.0095, and hence this product is still non-compliant with the EPA emission standard requiring a Sulfur Factor of no more than 0.00723 as noted in Table I. This is confirmed by the computed $SO_2$:Btu ratio of 1.57 which exceeds the EPA limit of 1.2 pounds of $SO_2$ per million Btu.

Assume, therefore, that the North Dakota lignite product is "cleaned" to remove heavier weight ash particles in addition to the reduction of total moisture to 5%. In Table 2 it is assumed, from the second column of figures under North Dakota lignite, that the ash percentage is reduced to 5%. Because pyritic sulfur will be removed along with the ash, it is assumed that the sulfur percentage (on a dry basis) in the fuel product is lowered to 0.6%. The non-moisture and ash percentage of the fuel product is thus 90%, and the Sulfur Factor computes to be 0.0067. This Sulfur Factor is less than the upper limit of 0.00723 (from Table I), and hence the North Dakota lignite fuel product is rendered in compliance with the applicable EPA emission standard by this moisture reduction and ash removal treatment. The heating value of the treated product computes to be 10,850 Btu per pound, and the $SO_2$ emission per million Btu computes to be 1.10, less than the upper limit of 1.2 constituting the EPA standard.

Refer now to FIG. 1 of the drawing, which shows in block diagram form a procedure at the combustion site for upgrading a fuel product so that the burning thereof will be in compliance with an applicable $SO_x$:Btu emission standard. Coal, typically in particle form, is applied to a drying unit 10 which is conventional. A number of suitable coal drying units are referred to in *Coal Preparation,* published by the American Institute of Mining, Metallurgical, and Petroleum Engineers, Inc. (New York 1968), edited by Joseph W. Leonard and David R. Mitchell. Following the drying step, the coal is applied to a conventional pulverizing unit 12 within which it is pulverized and thereafter burned in a boiler. Waste heat from the combustion process (not stack gas containing sulfur) may be utilized in a recycling operation to assist in the pulverizing and drying operations. The arrangement shown in FIG. 1 is suitable for the handling of coal such as the Wyoming Powder River Basin subbituminous coal discussed above in connection with Tables I and 2. Such subbituminous coal may be upgraded so that it is in compliance with the applicable EPA emission standard simply by undergoing drying, as noted.

If a coal product such as North Dakota lignite referred to in Tables I and 2 above is to be burned, then a system as shown in FIG. 2 is required. In this case, pulverized coal is applied to a drying and separating unit 14. Such a unit may constitute an "airflow cleaner" as shown and described on pages 11-6 to 11-8 in *Coal Preparation* cited above. In such a unit, not only is the coal dried, but heavier weight particles of coal are separated and removed. Thus, heavier weight ash particles containing pyritic sulfur (as distinguished from inherent sulfur) are removed. The product that emerges from the drying and separating unit 14 thus has its moisture content significantly reduced as well as its sulfur content, both sufficiently so that the product is in compliance with the applicable EPA emission standard. The product is applied to a pulverizing unit 16 and thence is burned. Again, waste heat recycling can be utilized for the drying and separating operation as well as the pulverizing operation.

FIG. 3 shows another form of system suitable for the treatment of coal to upgrade it, in which the product is initially dried in a dryer 18. Following drying, the coal product is then pulverized. The initial drying of the product increases the efficiency of the pulverizer and improves its operation, as is well known. Following pulverization in the pulverizer 20, the product is applied to a separator 22 which separates out heavier weight ash particles containing pyritic sulfur. The product from the separator is applied to a final pulverizing unit 24, from which it is applied to a furnace for burning. As in the other arrangements described, waste heat recycling may be employed in the operation of the various units. With an arrangement such as shown in FIG. 3, it is possible to utilize a lesser pulverizing capacity in the entire system as might otherwise be required. By separating the pulverizing operations into initial and final pulverizing, the final pulverizer 24 has less of a product to handle than the initial pulverizer 20 in view of the separation out of the heavier weight ash particles. By utilizing some pulverizing following separation, less of a total pulverizer capacity is required than if all pulverizing were done prior to the separating step.

By upgrading fuel products as noted, significant cost savings can be realized. In particular, it is possible to install drying and separating units below the coal bunker now found in an electric utility generating station, for example. Little extra space is required for the installation of such units. Additionally, expensive stack gas scrubbing units are completely avoided.

The present invention thus approaches the problem of air pollution from the standpoint of upgrading the heating value of the fuel product rather than from the more expensive flue gas treatment proposed by others in the field. It is apparent that the presently preferred embodiments described above are subject to modification. Accordingly, the invention should be taken to be defined by the following claims.

What we claim is:

1. The method of upgrading subbituminous coal and/or lignite fuel product non-complying with an applicable $SO_x$:Btu standard during the combustion thereof, comprising drying said fuel product at the combustion site to lower the total moisture content thereof from between about 15 and 45 percent to between about 4 and 7 percent to concomitantly raise the heating value of said fuel product sufficiently so that said $SO_x$:Btu standard will be met during the combustion of said fuel product, and thereafter burning said fuel product while it is in the latter total moisture content range.

2. The method of claim 1, wherein said fuel product is in particle form, and including the further step of removing heavier weight ash particles from said fuel product prior to the burning thereof to lower the sulfur content of said fuel product.

3. The method of claim 1, wherein the ratio of the sulfur content of said fuel product to the non-moisture and ash content of said fuel product, subsequent to said drying step, is less than a predetermined value dependent upon the heating value and non-moisture and ash content of said fuel product prior to said drying step and said applicable $SO_x$:Btu standard.

4. A method according to claim 1, wherein waste heat generated during said burning of said fuel product is used to dry said fuel product.

5. A method of upgrading the combustion quality of solid particle subbituminous coal and/or lignite fuel product comprising, at the combustion site, drying said fuel particles to reduce the moisture content thereof and concomitantly raise the heating value thereof and removing heavier weight ash particles therefrom to lower the sulfur content thereof, and then burning said fuel particles.

6. Apparatus for upgrading solid particle subbituminous coal and/or lignite fuel product non-complying with an applicable $SO_x$:Btu standard during the combustion thereof, comprising means for drying said fuel product at the combustion site, and including separating means for removing heavier weight ash particles from said fuel product prior to the burning thereof to lower the sulfur content thereof.

7. Apparatus according to claim 6, including pulverizing means for pulverizing said fuel product, said pulverizing means receiving particles of fuel product from said drying and separating means.

8. Apparatus according to claim 6, including pulverizing means for pulverizing said fuel product, said pulverizing means receiving particles of said fuel product from said drying means and applying them to said separating means.

9. Apparatus according to claim 8, further including additional pulverizing means receiving said fuel product from said separating means to further pulverize said fuel product.

10. Apparatus according to claim 9, including means for conveying said fuel product from said additional pulverizing means to a furnace for combustion thereof.

11. Apparatus according to claim 6, including furnace means receiving said fuel product from said drying and separating means for burning said fuel product, and waste heat recycling means for applying waste heat generated during the burning of said fuel product to said drying means to provide the heat for the drying of said fuel product.

12. Apparatus according to claim 11, wherein said waste heat recycling means includes blowing means for blowing heated gas to said separating means to aid in the separation of said heavier weight particles.

* * * * *